US011784382B1

(12) United States Patent
Podell et al.

(10) Patent No.: US 11,784,382 B1
(45) Date of Patent: Oct. 10, 2023

(54) TWO-WAY SPLITTER WITH CROSSOVER

(71) Applicant: Werlatone, Inc., Brewster, NY (US)

(72) Inventors: Allen F. Podell, Palo Alto, CA (US); Ky-Hien Do, Carp (CA); Mariama Dadhi Barrie, Brewster, NY (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 18/171,241

(22) Filed: Feb. 17, 2023

(51) Int. Cl.
*H01P 3/08* (2006.01)
*H01P 5/12* (2006.01)

(52) U.S. Cl.
CPC . *H01P 3/08* (2013.01); *H01P 5/12* (2013.01)

(58) Field of Classification Search
CPC ..... H01P 3/08; H01P 5/12
See application file for complete search history.

(56) References Cited

U.S. PATENT DOCUMENTS

| | | | | |
|---|---|---|---|---|
| 3,091,743 | A | 5/1963 | Wilkinson | |
| 3,529,365 | A | 9/1970 | Shelley | |
| 4,721,929 | A | 1/1988 | Schnetzer | |
| 6,121,853 | A * | 9/2000 | London | H01P 5/12 333/127 |
| 6,246,299 | B1 | 6/2001 | Werlau | |
| 7,190,240 | B2 | 3/2007 | Podell | |
| 8,482,362 | B1 | 7/2013 | Podell | |
| 8,493,162 | B1 | 7/2013 | Podell | |
| 9,325,051 | B1 | 4/2016 | Podell et al. | |
| 10,978,772 | B1 | 4/2021 | Podell et al. | |

FOREIGN PATENT DOCUMENTS

KR 20190096041 A * 8/2018

OTHER PUBLICATIONS

Cohn, Seymour B, "A Class of Broadband Three-Port TEM-Mode Hybrids", IEEE Transactions on Microwave Theory and Techniques, vol. 16, No. 2, Feb. 1968, pp. 110-116.
Harty, Daniel D., "Novel Design of a Wideband Ribcage-Dipole Array and Its Feeding Network", Thesis, submitted to Worcester Polytechnic Institute on Dec. 17, 2010, 106 pgs.
Park et al., "A 700- to 2500-MHz microstrip balun using a Wilkinson divider and 3-dB quadrature couplers", Microwave and Optical Technology Letter, vol. 47, No. 4, Nov. 20, 2005, pp. 333-335.
Rondeau, Gary, "Modeling Baluns and Transformers with NEC Codes", Squash Practice a Growing Concern, vww.squashpractice.com, Mar. 11, 2020, 11 pgs.

* cited by examiner

*Primary Examiner* — Andrea Lindgren Baltzell
*Assistant Examiner* — Kimberly E Glenn
(74) *Attorney, Agent, or Firm* — Kolisch Hartwell, P.C.

(57) ABSTRACT

A transmission-line network includes first, second, third, and fourth transmission lines. Signal conductors of the first and third transmission lines are connected in series and the signal conductors of the second and fourth transmission lines are connected in series. Signal-return conductors of the first and fourth transmission lines are connected in series. The signal-return conductors of the second and third transmission lines are connected in series. A first resistor may be connected between a junction between the signal conductors of the first and third transmission lines and a junction between the signal conductors of the second and fourth transmission lines. A second resistor may be connected between a junction between the signal-return conductors of the first and fourth transmission lines and a junction between the signal-return conductors of the second and third transmission lines.

9 Claims, 2 Drawing Sheets

TWO-WAY SPLITTER WITH CROSSOVER

INTRODUCTION

Power splitters or dividers are passive microwave components used for distributing or combining microwave signals. A splitter is a reciprocal device and can be used as either a power combiner or a power divider. There are various reasons for dividing and combining high-power high-frequency signals. For example, a signal may be divided into multiple signal paths so that each signal path has a power level that individual amplifiers can efficiently process. The outputs of the amplifiers may then be combined to form an amplified high-power signal. A signal may also be divided into multiple signal paths for feeding a phased-array antenna.

One approach to dividing a signal or combining multiple signals is to divide in stages, with each stage combining or dividing two signals at a time. The flexibility of the two-way divider's feed structure allows use of multiple stepped-sections to achieve power division with the capability of wideband operation. The bandwidth is primarily limited by the match of the radiating elements, although having isolation between component ports reduces dependence on the match of the loads.

The Wilkinson power splitter was invented around 1960 by an engineer named Ernest Wilkinson. It splits an input signal into two equal phase output signals, or combines two equal-phase signals into one in the opposite direction. Quarter-wave transformers match the impedances of the split or component ports to the common or sum port. A resistor between the component ports allows all three ports to be matched and it provides isolation between the two component ports.

SUMMARY

The present disclosure is directed to a power splitter having a crossover in the component signal or signal-return paths. In some embodiments, a transmission-line network includes first, second, third, and fourth transmission lines each having a common characteristic impedance, a length corresponding to a quarter wavelength of a circuit operating frequency of the transmission-line network, a first end, a second end, a signal conductor, and a signal-return conductor. The first ends of the signal conductors of the first and second transmission lines are connected to a first circuit node. The second end of the signal conductor of the first transmission line and the first end of the signal conductor of the third transmission line are connected to a second circuit node. The second end of the signal conductor of the second transmission line and the first end of the signal conductor of the fourth transmission line are connected to a third circuit node.

The first end of the signal-return conductors of the first and second transmission lines and the second ends of the signal-return conductors of the third and fourth transmission lines are each connected to a circuit ground. The second end of the signal-return conductor of the first transmission line and the first end of the signal-return conductor of the fourth transmission line are connected to a fourth circuit node. The second end of the signal-return conductor of the second transmission line and the first end of the signal-return conductor of the third transmission line are connected to a fifth circuit node.

In some embodiments, a transmission-line network includes first, second, third, and fourth transmission lines each having a common characteristic impedance, a length corresponding to a quarter wavelength of a circuit operating frequency of the transmission-line network, a first end, a second end, a signal conductor, and a signal-return conductor. The signal conductors of the first and third transmission lines are connected in series between a sum node and a first component node and the signal conductors of the second and fourth transmission lines are connected in series between the sum node and a second component node. The signal-return conductors of the first and fourth transmission lines are connected in series between respective circuit grounds. The signal-return conductors of the second and third transmission lines are connected in series between respective circuit grounds.

In some examples, such a transmission-line network further includes a first resistor connected between a junction between the signal conductors of the first and third transmission lines and a junction between the signal conductors of the second and fourth transmission lines. A second resistor is connected between a junction between the signal-return conductors of the first and fourth transmission lines and a junction between the signal-return conductors of the second and third transmission lines.

Features, functions, and advantages may be achieved independently in various embodiments of the present disclosure, or may be combined in yet other embodiments, further details of which can be seen with reference to the following description and drawings.

DESCRIPTION

Figure 1:
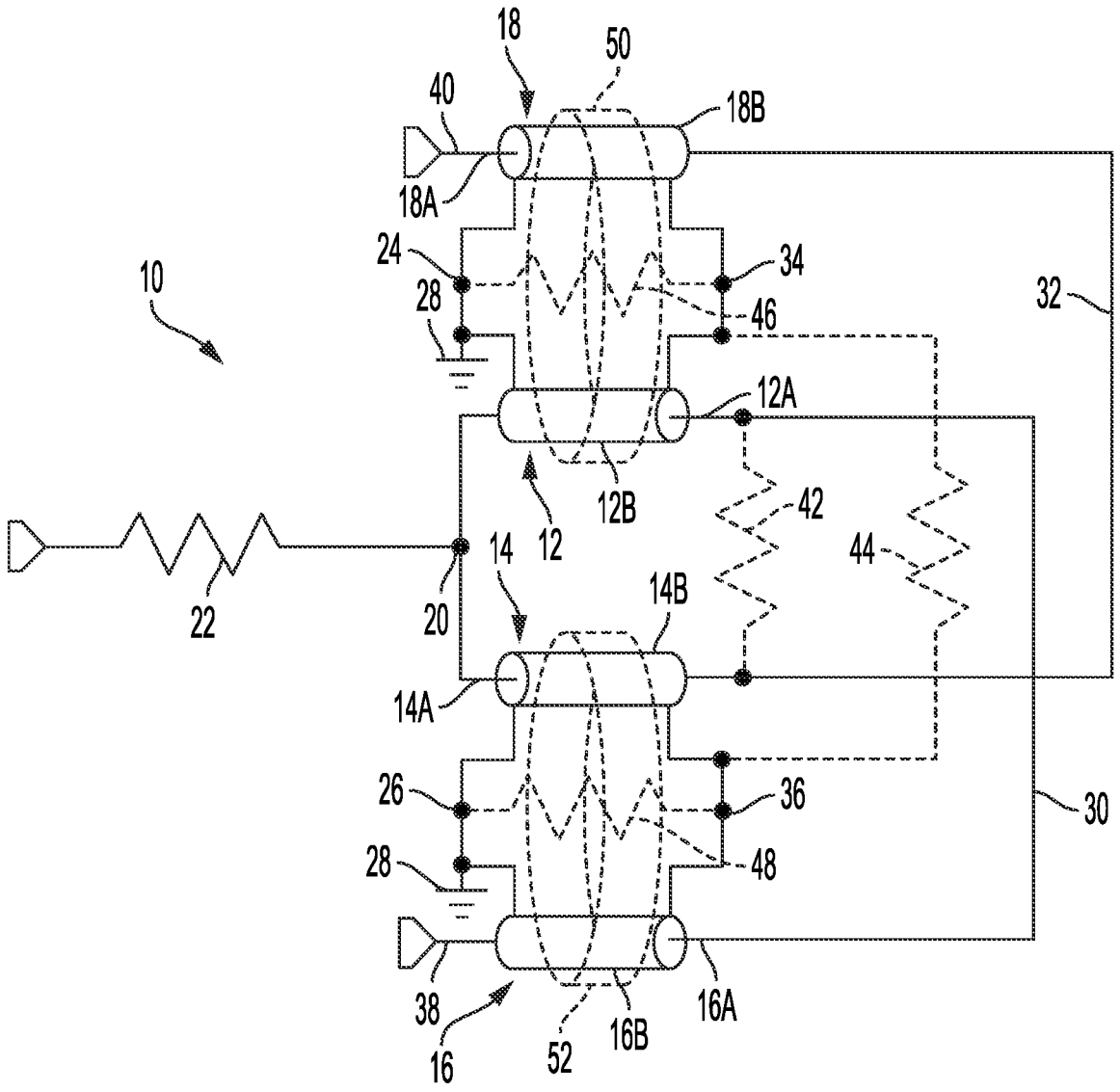
FIG. 1 is an exemplary circuit diagram of a splitter with crossover.

Various embodiments of a power splitter having crossover of signal-return conductors between split signal paths are described below and illustrated in the associated drawings. Unless otherwise specified, such a power splitter and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the power splitter may, but are not required to, be included in other dividers and combiners. The features described in the following description of various embodiments are merely exemplary in nature and are in no way intended to limit its application or uses. Additionally, the advantages provided by the embodiments, as described below, are illustrative in nature and not all embodiments provide the same advantages or the same degree of advantages.

As mentioned, signal conductors of first and fourth transmission lines of the preferred power splitter, referred to generally as a transmission-line network, may be connected in series between a sum node and a first component node and signal conductors of second and third transmission lines may be connected in series between the sum node and a second component node. Signal-return conductors of the first and third transmission lines may be connected in series between respective circuit grounds, and signal-return conductors of the second and third transmission lines may be connected in series between respective circuit grounds. Such a transmission-line network provides improved isolation between signals on the first and second component nodes.

As used herein, a "node" is a location on a circuit between two circuit elements or components. In circuit diagrams, connections are ideal wires with zero resistance, so a node consists of the entire section of "wire" between elements, not just a single point. A node of a circuit, such as a terminal, pair of terminals, or connector, that is available or configured for connection to an external circuit may also be referred to as a "port."

Two conductors are electrically connected when there is an electron current path between them, including any conductors and electron-conductive electrical elements, such as resistors and inductors, but not coupling by either electromagnetic induction, such as inductive coupling or capacitive coupling, or electromagnetic radiation such as radio waves. Two conductors or other components are directly electrically connected when there are no intervening electrical elements.

Ordinal terms such as "first", "second", and "third" are used to distinguish or identify various members of a group, or the like, typically in the order they are introduced in a particular context, and are not intended to show serial or numerical limitation, or be fixed identifiers for the group members. Accordingly, the ordinal indicator used for a particular element may vary in different contexts.

Where "a" or "a first" element or the equivalent thereof is recited, such usage includes one or more such elements, neither requiring nor excluding two or more such elements.

A transmission line may be constructed as one of various forms well known in the art if not defined to be of a specific type. For example, a transmission line may be a coaxial transmission line, twisted pair, strip line, coplanar waveguide, slot line, or microstrip line. Whatever the form, each transmission line may include a pair of electrically spaced apart, inductively coupled conductors that conduct or transmit a signal defined by a voltage difference between the conductors.

These conductors may be described interchangeably as a signal conductor and a signal-return conductor. In the drawings, signal conductors are given the designation "A" and signal-return conductors are given the designation "B." For example, the signal conductor of a transmission line 12 is designated with reference numeral 12A and the signal-return conductor of transmission line 12 is designated with reference numeral 12B. Other transmission lines are designated in similar fashion.

In some types of transmission lines a signal-return conductor may be a shield conductor, as in a coaxial transmission line, as shown in FIG. 1, or a strip line. A signal-return conductor may also be referred to as a ground conductor, whether or not it is connected to a local ground, a circuit ground, a system ground, or an earth ground. A signal conductor may be referred to as a shielded conductor or as a center conductor, such as in a coaxial transmission line. Transmission lines may also have differing lengths or the same lengths depending on the intended phase relationships desired.

Transmission lines may be configured to form baluns, where an unbalanced signal exists at one end of the transmission line where the signal-return conductor is connected to circuit ground, and a balanced signal exists at the other end of the transmission line. The voltage difference between the signal and signal-return conductors stays the same along the transmission line, but the voltage on each conductor relative to ground gradually changes progressing from the unbalanced-signal end toward the balanced-signal end. At the balanced-signal end, the voltage relative to circuit ground on the signal conductor may be half the voltage on the signal conductor at the unbalanced-signal end, and the voltage on the signal-return conductor may be the negative complement of the voltage on the signal conductor. This arrangement leads to a voltage variation or gradient along the length of the transmission line relative to circuit ground, because the voltages on the signal conductor and the signal-return conductor transition between the different voltages at each end.

A transmission-line network may also include one or more ferrite sleeves. The structure of the balun may produce spurious signals between a conductor and circuit ground, which spurious signals may be choked by a ferrite sleeve extending around the conductor. A ferrite sleeve may be a block, bead, ring, or layers of ferrite material configured as appropriate to suppress high frequency spurious signals, noise, or other signals relative to ground on the transmission line. Transmission lines having unshielded conductors with the same voltage to ground may use a common ferrite sleeve. Combining transmission lines in a single ferrite sleeve may reduce overall hysteresis losses caused by the ferrite.

Turning now to the example depicted in FIG. 1, an illustrative transmission-line network 10 is shown. Transmission lines included in transmission-line network 10 are represented as coaxial transmission lines, although they may be of other forms of transmission line as has been mentioned. The center conductor of each coaxial transmission line is referred to herein as the signal conductor. Accordingly, the shield conductor surrounding the center conductor is referred to below as the signal-return conductor.

Transmission-line network 10 includes transmission lines 12, 14, 16, and 18. The transmission lines each have a common characteristic impedance, such as 50 ohms, a length corresponding to a quarter wavelength of a circuit operating frequency of the transmission-line network, a first end, a second end, a signal conductor, and a signal-return conductor. Specifically, transmission lines 12, 14, 16, and 18 have respective signal conductors 12A, 14A, 16A, and 18A and respective signal-return conductors 12B, 14B, 16B, and 18B.

First ends of respective signal conductors 12A and 14A of transmission lines 12 and 14 are connected to a circuit node 20. Circuit node 20, also referred to as a sum circuit node or just sum node, thus forms a junction connecting a signal input on circuit node 20 to transmission lines 12 and 14. Circuit node 20 may also serve as an input port in the case of use of transmission-line network 10 as a power splitter. Transmission-line network 10 is configured to be connected at circuit node 20 to an external input circuit having a source or input impedance, such as 50 ohms, which is represented schematically by a resistor 22.

In this example, the first end of signal-return conductor 12B and the second end of signal-return conductor 18B are connected together at a circuit node 24. Also, the first end of signal-return conductor 14B and the second end of signal-return conductor 16B are connected together at a circuit node 26. Circuit nodes 24 and 26 are each connected to a circuit ground 28.

A second end of signal conductor 12A of transmission line 12 and a first end of signal conductor 16A of transmission line 16 are connected to a circuit node 30. A second end of signal conductor 14A of transmission line 14 and a first end of signal conductor 18A of transmission line 18 are connected to a circuit node 32.

A second end of signal-return conductor 12B of transmission line 12 and a first end of signal-return conductor 18B of transmission line 18 are connected to a circuit node 34. Further, a second end of signal-return conductor 14B of transmission line 14 and a first end of signal-return conductor 16B of transmission line 16 are connected to a circuit node 36.

A second end of signal conductor 16A is connected to a component circuit node 38, also referred to simply as a component node, which may also be configured as a first component or output port. A second end of signal conductor 18B is connected to a component circuit node 40, also referred to as a component node, which may also be configured as a second component or output port. A signal input on sum node 20 is divided and output on the respective component nodes 38 and 40.

This configuration of transmission-line network 10 has signal conductors 12A and 16A connected in series between sum circuit node 20 and component circuit node 40. Similarly, signal conductors 14A and 18A are connected in series between sum circuit node 20 and component circuit node 38. However, signal-return conductors 12B and 18B are connected in series between respective circuit grounds. Similarly, signal-return conductors 14B and 16B are connected in series between respective circuit grounds. Accordingly, it is seen that the series-connected signal conductors cross over each other relative to the series-connected signal-return conductors. Conversely, the series-connected signal-return conductors in effect cross over each other relative to the series-connected signal conductors. This cross-over of conductors provides improved isolation between the component circuit nodes.

Isolation between the component circuit nodes may be further increased by adding two isolation resistors, shown in dashed lines. A first resistor 42 is shown connected between circuit nodes 30 and 32. Resistor 42 is thus connected between the second ends of signal conductors 12A and 14A. A second resistor 44 is shown connected between circuit nodes 34 and 36. Resistor 44 is thus connected between the second ends of signal-return conductors 12B and 14B. Resistors 42 and 44 shunt any differences in the signals between the second ends of the conductors of transmission lines 12 and 14.

Further optional resistors 46 and 48 are shown extending between the opposite ends of the signal-return lines 12B and 18B, and 14B and 16B, respectively. Resistors 46 and 48 represent the effect of ferrite sleeves to choke spurious signals that otherwise exist on the signal-return conductors of the transmission lines. Specifically, a ferrite sleeve 50 is shown in dashed lines around both of transmission lines 12 and 18. Similarly, a ferrite sleeve 52 is shown in dashed lines around both of transmission lines 14 and 16. Alternatively, each transmission line may have a separate ferrite sleeve.

Figure 2:
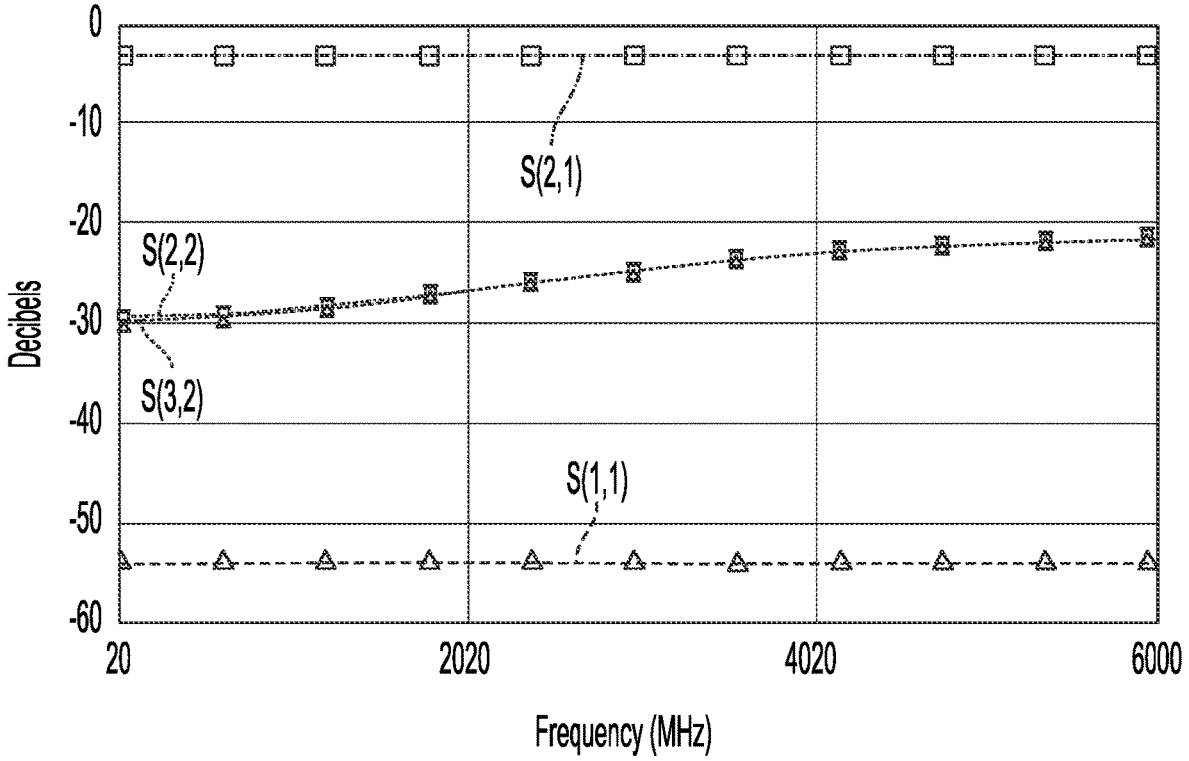
FIG. 2 is a chart showing representative ideal scattering parameters versus frequency for the splitter of FIG. 1.

FIG. 2 is a chart showing representative ideal scattering parameters over a frequency range of 20 MHz to 6 GHz for splitter 10 including the two isolation resistors and ferrite sleeves. It is seen that the insertion loss (S(2,1)) is about 3 dB below the input reference signal, corresponding to an equal split of the input signal. The input return loss at the sum node (S(1,1) is below 50 dB below the input signal level. Isolation between the two component ports (S(3,2) and the component signal return loss (S(2,2)) are both more than 20 dB below the input reference so a "short condition" at a component node would have little influence on the signal at the other component node.

The different embodiments of the power splitter described herein provide improved isolation between the component signals. However, not all embodiments described herein provide the same advantages or the same degree of advantage.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed:

1. A transmission-line network comprising first, second, third, and fourth transmission lines each having a common characteristic impedance, a length corresponding to a quarter wavelength of a circuit operating frequency of the transmission-line network, a first end, a second end, a signal conductor, and a signal-return conductor; wherein the first ends of the signal conductors of the first and second transmission lines are connected to a first circuit node, the second end of the signal conductor of the first transmission line and the first end of the signal conductor of the third transmission line are connected to a second circuit node, the second end of the signal conductor of the second transmission line and the first end of the signal conductor of the fourth transmission line are connected to a third circuit node, the first end of the signal-return conductors of the first and second transmission lines and the second ends of the signal-return conductors of the third and fourth transmission lines are each connected to a circuit ground, the second end of the signal-return conductor of the first transmission line and the first end of the signal-return conductor of the fourth transmission line are connected to a fourth circuit node, and the second end of the signal-return conductor of the second transmission line and the first end of the signal-return conductor of the third transmission line are connected to a fifth circuit node.

2. The transmission-line network of claim 1 further comprising a first resistor connected between the second and third circuit nodes and a second resistor connected between the fourth and fifth circuit nodes.

3. The transmission-line network of claim 2 further comprising a first ferrite sleeve extending around both the first and fourth transmission lines and a second ferrite sleeve extending around both the second and third transmission lines.

4. The transmission-line network of claim 1 further comprising a first ferrite sleeve extending around both the first and fourth transmission lines and a second ferrite sleeve extending around both the second and third transmission lines.

5. The transmission-line network of claim 1 wherein the first circuit node is a sum node and the second ends of the signal conductors of the third and fourth transmission lines are connected to respective component nodes, whereby a signal input on the first circuit node is divided and output on the respective component nodes.

6. A transmission-line network comprising first, second, third, and fourth transmission lines each having a common characteristic impedance, a length corresponding to a quarter wavelength of a circuit operating frequency of the transmission-line network, a first end, a second end, a signal conductor, and a signal-return conductor; wherein the signal conductors of the first and third transmission lines are connected in series between a sum node and a first component node and the signal conductors of the second and fourth transmission lines are connected in series between the sum node and a second component node, the signal-return conductors of the first and fourth transmission lines are connected in series between respective circuit grounds, and the signal-return conductors of the second and third transmission lines are connected in series between respective circuit grounds.

7. The transmission-line network of claim 6 further comprising a first resistor connected between a junction between the signal conductors of the first and third transmission lines and a junction between the signal conductors of the second and fourth transmission lines, and a second resistor connected between a junction between the signal-return conductors of the first and fourth transmission lines and a junction between the signal-return conductors of the second and third transmission lines.

8. The transmission-line network of claim 7 further comprising a first ferrite sleeve extending around both the first and fourth transmission lines and a second ferrite sleeve extending around both the second and third transmission lines.

9. The transmission-line network of claim 6 further comprising a first ferrite sleeve extending around both the first and fourth transmission lines and a second ferrite sleeve extending around both the second and third transmission lines.

* * * * *